United States Patent [19]

Yoshikawa et al.

[11] Patent Number: 4,822,414

[45] Date of Patent: Apr. 18, 1989

[54] AL-BASED ALLOY COMPRISING CR AND TI

[75] Inventors: Katsuyuki Yoshikawa; Hidetoshi Inoue; Tsukasa Shiomi; Shojiro Oie; Mutsumi Abe, all of Kobe, Japan

[73] Assignee: Kabushiki Kaisha Kobe Seiko Sho, Kobe, Japan

[21] Appl. No.: 50,462

[22] Filed: May 18, 1987

[30] Foreign Application Priority Data

May 19, 1986 [JP] Japan ..... 61-114306

[51] Int. Cl.[4] ..... C22C 21/00

[52] U.S. Cl. ..... 75/249

[58] Field of Search ..... 75/249; 420/551, 552

[56] References Cited

U.S. PATENT DOCUMENTS 3,954,458 5/1976 Roberts ..... 75/249

4,347,076 8/1982 Ray et al. ..... 75/249

4,647,321 3/1987 Adam ..... 75/249

4,668,470 5/1987 Gilman et al. ..... 75/249

FOREIGN PATENT DOCUMENTS 136508 4/1985 European Pat. Off. ..... 75/249

2088409 6/1982 United Kingdom ..... 75/249

*Primary Examiner*—John F. Terapane

*Assistant Examiner*—Eric Jorgensen

*Attorney, Agent, or Firm*—Oblon, Fisher, Spivak, McClelland & Maier

[57] ABSTRACT

Al-based alloys comprising predetermined amounts of Cr and Ti with the balance being Al and inevitable impurities. The alloys are made by powder metallurgy by which the additive elements are finely dispersed in an Al matrix. The alloys may further comprise up to 5 wt. %. of Fe.

6 Claims, 12 Drawing Sheets

AL-BASED ALLOY COMPRISING CR AND TI

BACKGROUND OF THE INVENTION

Field of the Invention

This invention relates to the art of powder metallurgy and more particularly, to Al-Cr alloys in which the content of Cr is limited within a certain range and a defined amount of Ti is also added with or without Fe. The alloys have well-balanced properties of a heat resistance, plastic workability and toughness.

Description of the Prior Art

Since Al alloys have a number of merits such as lightweight, good working properties and the like, wide utility as a substitute for iron in the fields of automobiles and aircrafts where lightweight is essentially required has been expected. For instance, in the field of automobile industries, there is the recent tendency that movable parts in a high temperature atmosphere, e.g. a connecting rod, are made light in weight so as to design an engine of a high performance. Accordingly, there is a strong demand for materials which are light in weight and high in strength for use as a substitute for iron.

However, known ingot metallurgy Al alloys (I/M alloys) are difficult to apply to parts which require high strength under high temperature atmospheric conditions such as, for example, various engine parts. With 2000 series alloys which are considerd to have the highest heat strength of the known I/M alloys, the strength is brought about mainly with the precipitation phase of Cu and Mg used as main additive elements. In a temperature range over 150° C. in which the precipitation phase is made coarse, the alloys are abruptly softened, making it too difficult to use as a strength member.

In recent years, various types of Al-based alloys have been developed using rapid solidification technique (R.S.T.) in order to meet the requirements in various fields of industries. For instance, a molten Al alloy containing metallic elements such as Fe, Cr, Mn, Ni, Ti, Zr, V and the like is rapidly solidified into the form of fine pieces such as powder. When the powder is consolidated to a massive body by means of the powder metallurgy, the thermally stable compounds which comprise the above-mentioned metallic elements are finely dispersed in the Al matrix. Thus, a great improvement of the high temperature strength can be expected.

Up to now, extensive studies have been made on Al-Fe based powder-metallurgical alloys having high heat resistance, such as Al-Fe-Ce alloys. In very recent years, attention has been drawn to the high heat resistance of Al-Cr-based alloys as reported by L. Katgerman et al (P/M Aerospace Materials 12–14, November 1984).

Al-Cr-based alloys are described, for example, in U.S. Pat. No. 4033793 and Japanese Laid-open patent application No. 59-116352. The alloys set forth in these publications have, respectively, good characteristics properties or features.

However, in practical applications, this type of alloy should have not only a heat resistance or heat strength, but also good plastic workability and high toughness. For example, when these alloys are applied as complicated parts such as a connecting rod, it is essential from the standpoint of costs that the alloy be worked by hot forging. At the same time, since the alloy inevitably suffers a given stress concentration during the working, the notch sensitivity should preferably be lower.

The existing alloys which have been hitherto studied and developed have not yet furnished all the characteristics which are practically essential. In this sense, the development of an alloy having well-balanced characteristic properties is very important and involves practical merits.

SUMMARY OF THE INVENTION

It is accordingly an object of the invention to provide an Al-based alloy obtained by powder metallurgy which has a high heat resistance, good plastic workability and toughness in a well-balanced condition.

It is another object of the invention to provide an Al-based alloy which has high room temperature strength.

It is a further object of the invention to provide an Al-based alloy which allows lightweight of engine parts and can improve a fuel-to-cost ratio and output power when applied in the field of automobile industries.

It is a still further object of the invention to provide an Al-based alloy which permits lightweight of skins, wheels and engine parts when applied in the field of aircrafts.

It is another object of the invention to provide an Al-based alloy which is especially useful in making various mechanical parts and electric parts of lightweight and high strength which are employed under high temperature conditions.

The above objects can be achieved, according to the present invention, by an Al-based alloy obtained by powder metallurgy which comprises from 5 to 10% by weight of Cr, from 0.5 to 3% by weight of Ti and the balance of Al and inevitable impurities. The alloy may further comprise not larger than 5% by weight of Fe. When Cr and Ti are present in the above-defined ranges, respectively, along with Al, the properties such as a heat resistance, plastic workability and toughness are imparted to the alloy in a well-balanced state. It will be noted that percent is by weight hereinafter unless otherwise indicated.

PREFERRED EMBODIMENTS OF THE INVENTION

Figure 1:
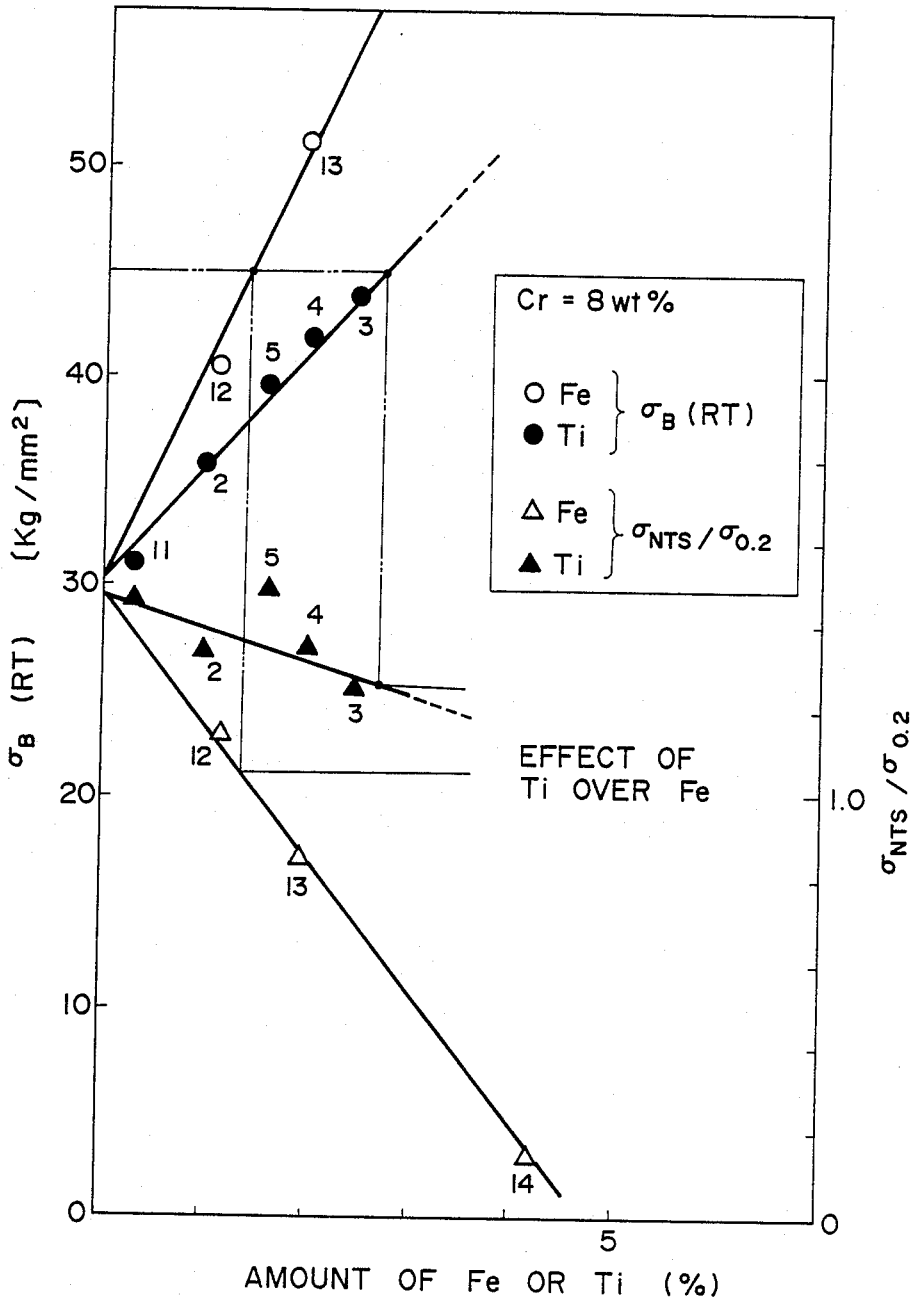
FIG. 1 is a graphical representation of the relation between room temperature tensile strength ($\sigma_B$) or toughness represented by notch tensile strength to 0.2% proof strength ratio ($\sigma_{NTS}/\sigma 0.2$) and amount of Fe or Ti in an Al-Cr alloy.

Fundamentally, the present invention is based on the effect of Cr that the heat resistance is improved when Cr is added to Al. Further, Ti and/or Fe is added to the Al-based alloy so as to further improve characteristic properties including the heat resistance. Especially, when the additive elements are used in controlled amounts, the resultant Al-based alloy has good workability and toughness as well as the heat resistance. Ti is important in the practice of the invention because Ti does not impede the toughness to a great extent although the heat resistance is significantly improved as will be described in detail hereinafter.

The Al-based alloy according to the invention should be one which is prepared by means of the powder metallurgy and can show specific characteristic properties by the adoption of the powder metallurgy.

In the Al-based alloy, it is essential that alloy elements be finely dispersed in an Al matrix. The formation of the finely dispersed structure is difficult to obtain by the ingot metallurgy technique, in which the cooling rate is low. In contrast, the powder metallurgy technique is a process in which a molten Al alloy is rapidly solidified to make fine powder, foils, flakes or ribbons, and these materials are used to from an Al alloy body or a desired form. Since the rapid solidification technique is used, the resultant structure has intermetallic compounds finely dispersed in the matrix.

In this connection, however, if alloy elements are those which are readily diffusable under high temperature conditions, they will diffuse at the time of sintering or in a high temperature environment even though a powder material having a fine structure is formed by the use of the rapid solidification techinque, thus rendering the microstructure coarse and lowering the elevated temperature strength. Accordingly, it is necessary to select alloy elements whose diffusability in a hot Al matrix is small. In view of the above, not only Cr, but also Ti and/or Fe is selected. However, when these alloy metals are used in large amounts, the workability is impeded and the demerits of these elements should also be taken into account. The choice and amount of alloy elements should be determined as a whole with the above in view.

On the other hand, the cooling rate at the time of the rapid solidification should also be considered so as to prevent formation of compounds of a coarse structure. The cooling rate should be not less than $10^3$ K/second. This is because the above-indicated elements have such small in equilibrium solid solution limits that when the cooling rate is below the above range, very coarse intermetallic compounds are formed. Thus, a finely dispersed metal structure cannot be obtained. It will be noted that any limitation is not placed in this invention on means for attaining a cooling rate not smaller than $10^3$ K/second. However, it is necessary to solidify a molten Al alloy into fine pieces such as powder, flake or ribbon to attain the above mentioned cooling rate. In order to make a massive solid body from the fine pieces, a powder metallurgy technique is necessary, so that the Al-based alloy of the invention has to be made by means of the powder metallurgy technique. Specific examples of the means for attaining a cooling rate not smaller than $10^3$ K/second, include a roll method and an atomization method. Limitation is not placed on the type or conditions when the atomization method is carried out, but it is recommended to use an inert gas as a fluid for the atomization because the compactibility is more improved when the surfaces of an atomized powder material is prevented from oxidation although air atomization may be used.

The effects and amounts of the respective elements used in the Al-based alloy according to the invention are described.

In the practice of the invention, Cr is used in an amount of from 5 to 10% of the alloy. Cr is an element whose diffusion rate in Al is small. Once the Cr containing solid solution and/or dispersoids are formed, they are difficult to form coarse intermetallic compounds not only at room temperature, but also at elevated temperatures. Accordingly, Cr shows a great effect of improving the strength at elevated temperatures. Cr should be added over 5%, inclusive, in order to expect the above effect, but when the amount exceeds 10%, coarse crystals start to be formed even according to the R.S.T. Thus, the expected effect cannot be obtained with lowering of workability and toughness.

Ti is added in an amount of from 0.5 to 3% of the alloy. Ti has the effect of enhancing the strength at room and elevated temperatures of the resultant Al alloy when coexisting with Cr. This effect is smaller than an effect of Fe as will be described hereinafter and becomes more pronounced when the amount of Ti exceeds 0.5%, inclusive. At the same time, if the amount of Ti increases, the toughness of the resultant alloy lowers only gently. Thus, Ti brings a significant improvement on the heat resistance without much deterimental effect on toughness.

However, Ti is a high melting point metal and has the effect of remarkably increasing a liquids temperature of the alloy. If the amount exceeds 3%, the melting temperature increases to such a high extent that several problems arise including considerable oxidation of Al, the reaction between a refractory material such as a crucible and the alloy, thus making it difficult to make the alloy.

The Al-based alloy may further comprise not larger than 5% of Fe. Fe markedly increases the strength of the alloy at room and elevated temperatures when coexisting with Cr. As mentioned before, this effect is greater than the effect of Ti, but Fe considerably lowers the toughness of the resultant alloy. The purposes of the invention are satisfactorily achieved by the ternary alloy of Al-Cr-Ti, but if higher strength is required, Fe is added in suitable amount while taking into account the lowering of toughness. In this sense, the lower limit in amount of Fe is not critical, but in order to show the effect of Fe significantly, it is preferable to add Fe in amounts not less than 0.3%. Over 5%, a dispersion phase becomes coarse even though the R.S.T. is applied, so that the workability and toughness of the resultant alloy lower considerably. In an extreme case, consolidation by means of the powder metallurgy technique would be difficult.

The balance in the Al-based alloy consists of Al and inevitable impurities. The Al ingot used for making the alloy of the invention may by any Al ingots which are commercially available and has a purity not less than 97%. Preferably, a primary ingot having a purity not less than 99% is used.

The Al-based alloy of the invention should comprise the above-defined composition and should preferably satisfy the following requirements (A) through (C) in order to obtain better characteristics.

(A) The total value by percent of Cr+2.4Fe+1.2Ti is not less than 8%, more preferably not less than 10%.

In order that the alloy of the invention has room temperature strength equal to or less than the strength of known structural alloys, or over 30 kgf/mm$^2$, the total value should not be less than 8%. For a room temperature strength of the alloy equal to or larger than the strength of known high strength alloys, or over 40 kgf/mm$^2$, the total amount should preferably be not less than 10%.

If Fe is not substantially added, Fe is made zero and the total value of Cr+1.2Ti should be preferably determined as not less than 8%, more preferably not less than 10%.

(B) As for plastic workability, the total value by percent of Cr+Fe+Ti should preferably be not larger than 10.5%, more preferably not larger than 10%. When the above total value exceeds 10.5% in the alloy of the invention, elongation and reduction of area which are important for plastic workability lower considerably. If the plastic workability is required, it is necessary to add the additive elements in a total amount not exceeding 10.5%. If the above total value is 10.5%, the values of the elongation and reduction of area scatter. To avoid this, the total value should favorably be not larger than 10%.

If Fe is not substantially added, Fe is zero and the total of Cr and Ti should be not larger than 10.5%, perferably not larger than 10%.

(C) When the total value of Cr+1.2Fe+0.6Ti exceeds 10%, the toughness of resultant alloy lowers considerably. Accordingly, if the toughness is required, it is necessary to incorporate the additive elements in a total amount of Cr+1.2Fe and 0.6Ti of not larger than 10%. If Fe is not added substantially, the content of Fe is zero and the total value by percent of Cr+0.6Ti is determined to be not larger than 10%.

The present invention is more particularly described by way of examples.

EXAMPLE 1

Alloys having the compositions indicated in Table 1 with the balance of Al and inevitable impurities were melted in an atmospheric furnace and each melt was atomized in a nitrogen atmosphere to obtain a fine alloy powder. It will be noted that the alloys indicated as Nos. 16 and 17 are I/M alloys for comparison. The alloy powder was collected and classified through a screen to obtain a 200 mesh undersize fraction (below 74 micrometers) for adjustment of a size distribution. The average size of the powder was from 20 to 40 micrometers.

The classified powder was filled in a 5052 alloy can having an outer diameter of 70 mm and a length of 200 mm, and heated at 350° C. for about 2 hours while evacuating the air in the can through a degassing port provided at one end of the can by the use of a vacuum pump. At the completion of the degassing operation, a degree of vacuum reached about $1\times10^{-3}$ Torr.

The degassed powder in the can was heated at 480° C. for 2 hours and subjected to hot extrusion at an extrusion ratio of about 20 by a hydrostatic extrusion method, thereby obtaining a substantially dense extrusion rod having an outer diameter of 15.5 mm.

The thus obtained rods where subjected to several tensile tests described below.

(1) Room temperature tension test
Shape of test pieces:
reduced section: 6mm×36mm
gage length: 30mm
Test method: ASTM B557M
(2) Sharp notch tension test
Shape of test pieces:
test section length; 30mm
test section diameter; 12.7mmϕ
notch valley diameter; 8.96mmϕ
notch angle; 60 deg
notch tip radius; 0.018mm
Test method, conditions: ASTM E602
(3) High temperature tensile test
Shape of test pieces:
reduced section diameter; 6mmϕ
reduced section length; 36mm
Test method: test temperature 300° C.
holding time: 20 minutes
other conditions ASTM E21

The results of the tensile tests obtained by the above methods and conditions are shown in Table 2. For comparison, typical properties of known 5052 and 2024 alloys are also shown.

TABLE 1

| | No. | Cr | Fe | Ti | Cr + 1.2 Ti | Cr + Ti | Cr + 0.6 Ti |
|---|---|---|---|---|---|---|---|
| Inventive Alloys | 1 | 9.43 | — | 2.47 | 12.4 | 11.9 | 10.9 |
| | 2 | 7.90 | — | 1.00 | 9.1 | 8.9 | 8.5 |
| | 3 | 8.01 | — | 2.43 | 10.9 | 10.4 | 9.5 |
| | 4 | 8.11 | — | 2.01 | 10.5 | 10.1 | 9.3 |
| | 5 | 8.04 | — | 1.59 | 9.9 | 9.6 | 9.0 |
| | 6 | 6.98 | — | 1.92 | 9.3 | 8.9 | 8.1 |
| | 7 | 6.08 | — | 2.85 | 9.5 | 8.9 | 7.8 |
| | 8 | 5.93 | — | 1.04 | 7.2 | 7.0 | 6.6 |
| Alloys for Comparison | 9 | 10.11 | — | 1.51 | 11.9 | 11.6 | 11.0 |
| | 10 | 4.54 | — | 2.59 | 7.6 | 7.1 | 6.1 |
| | 11 | 8.09 | — | 0.30 | 8.4 | 8.4 | 8.3 |
| | 12 | 8.02 | 1.10 | — | — | — | — |
| | 13 | 8.09 | 2.04 | — | — | — | — |
| | 14 | 7.97 | 4.19 | — | — | — | — |
| | 15 | 10.14 | — | — | — | — | — |
| | 16 | 5052 H alloy (IM alloy) | | | Al—2.5 Mg—0.2 Cr—0.1 Mn | | |
| | 17 | 2024 T4 alloy (I/M alloy) | | | Hl—4.3 Cu—1.5 Mg—0.6 Mn—0.1 Cr—0.2 Te | | |

TABLE 2

| | No. | Normal Temperature Tensile Strength σ0.2 (kg/mm²) | σB (kg/mm²) | δ (%) | ψ (%) | σNTS/σ0.2 | High Temperature Tensile Strength (300° C.) σ0.2 (kg/mm²) | σB (kg/mm²) | δ (%) | ψ (%) |
|---|---|---|---|---|---|---|---|---|---|---|
| Inventive Alloys | 1 | 41.8 | 51.5 | 0.2 | 0.2 | 0.60 | 22.1 | 27.0 | 1.0 | 3.2 |
| | 2 | 26.0 | 35.8 | 20.0 | 42.8 | 1.35 | 14.6 | 19.7 | 6.8 | 12.7 |
| | 3 | 34.5 | 44.1 | 5.4 | 10.2 | 1.26 | 21.9 | 24.5 | 3.8 | 7.6 |
| | 4 | 34.1 | 41.9 | 17.3 | 18.9 | 1.35 | 18.7 | 22.6 | 6.1 | 11.0 |
| | 5 | 30.7 | 39.7 | 25.8 | 31.6 | 1.49 | 17.8 | 21.1 | 6.5 | 11.8 |
| | 6 | 27.0 | 37.0 | 28.8 | 42.3 | 1.69 | 15.7 | 19.3 | 9.9 | 20.1 |
| | 7 | 27.1 | 38.0 | 31.4 | 45.6 | 1.70 | 17.3 | 20.6 | 11.3 | 22.8 |
| | 8 | 24.8 | 30.9 | 36.2 | 44.9 | 2.09 | 14.5 | 18.7 | 14.1 | 22.5 |
| Alloys for Comparison | 9 | — | 48.1 | 0.1 | 0.1 | 0.50 | 20.6 | 24.8 | 1.2 | 2.4 |
| | 10 | 20.2 | 28.7 | 37.9 | 48.6 | 2.59 | 14.6 | 17.2 | 16.3 | 23.5 |
| | 11 | 24.3 | 30.1 | 18.9 | 30.3 | 1.46 | 14.7 | 15.7 | 7.0 | 19.4 |
| | 12 | 31.5 | 40.4 | 18.2 | 25.3 | 1.15 | 17.4 | 19.9 | 7.7 | 18.3 |
| | 13 | 41.5 | 51.2 | 6.1 | 5.9 | 0.86 | 20.2 | 25.4 | 6.5 | 10.7 |
| | 14 | 49.3 | 58.1 | 0.3 | 0.4 | 0.15 | 23.8 | 28.4 | 0.4 | 0.5 |
| | 15 | 34.7 | 43.6 | 5.3 | 7.9 | 0.79 | 16.6 | 20.1 | 4.6 | 7.1 |
| | 16 | 22.0 | 26.5 | 14 | | | — | — | — | |
| | 17 | 29.5 | 43.5 | 20 | | | 8 | 9 | 36 | |

In order to determine the variation in characteristics of Al-8%Cr based alloys to which Ti and Fe are, respectively, added singly, the comparison was made between Nos. 2, 3, 4 and 5 and Nos. 11, 12, 13 and 14. The results are shown in FIG. 1.

The results reveal that Fe and Ti can each increase the room temperature strength, while decreasing $\sigma_{NTS}/\sigma 0.2$ (the notched tensile strength to room temperature proof strength ratio). The value of $\sigma_{NTS}/\sigma 0.2$ not only shows a degree of notch sensitivity to a tensile load (a lower value resulting in a high notch sensitivity), but also is adopted as one of parameters for the evaluation of toughness. In general, the value of $\sigma_{NTS}/\sigma 0.2$ is required to be higher than 1. As shown by two dots-dash line in the FIG., the amounts of Ti and Fe capable of yielding a $\sigma_{B\ level\ of}$ 45 kgf/mm² are respectively, 2.7% and 2.4%. When the values of $\sigma_{NTS}/\sigma 0.2$ at the levels are compared, they are about 1.28 and 1.08, respectively, revealing that Ti is more effective in improving the toughness by about 20% than Fe.

Figure 2:
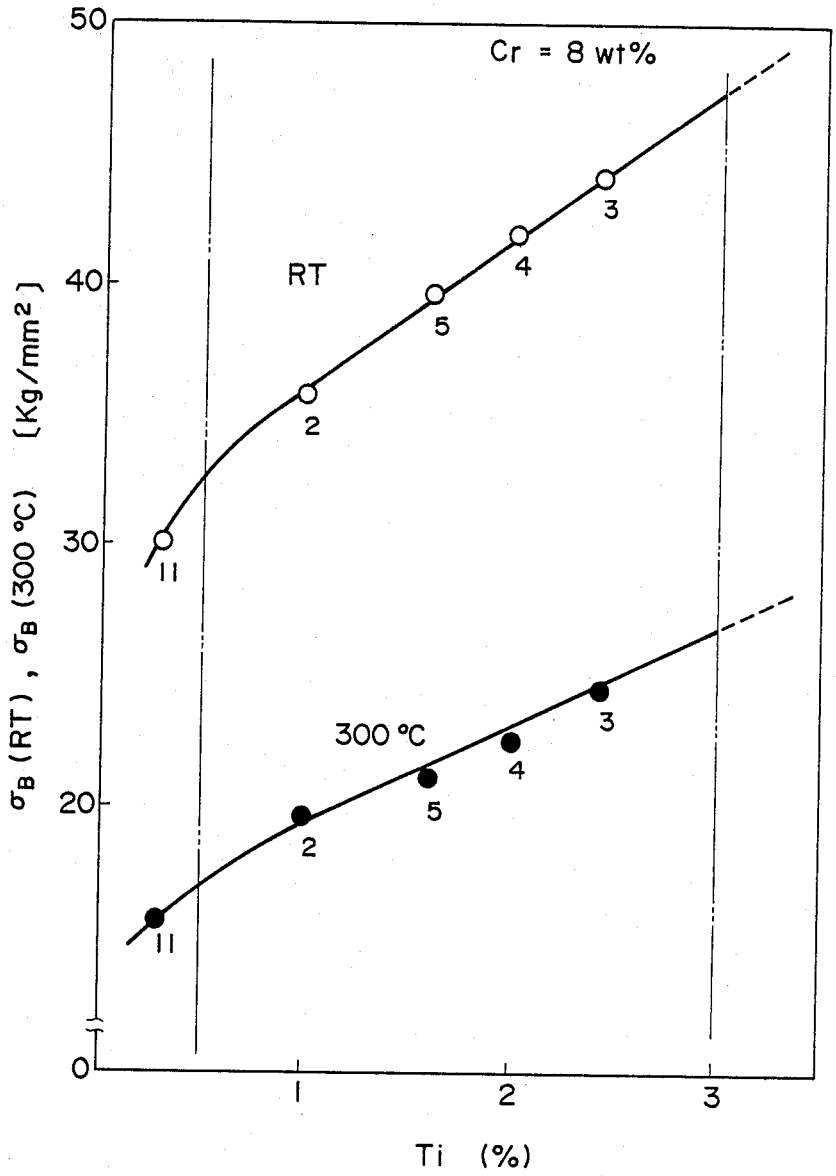
FIG. 2 is a graphical representation of room temperature strength and elevated temperature strength in relation to the variation in amount of Ti in an Al-Cr alloy.

FIG. 2 demonstrates that the effect of Ti becomes significant in a range not less than 0.5%. Although not shown in Table 1, an alloy of Al-8%Cr-3.5%Ti was made during a series of experiments, whereupon it was found that at a temperature of about 1500° C., the molten alloy reacted with a graphite/clay crucible and oxides (slag) were produced considerably. This involved a difficulty in making the alloy.

Figure 3:
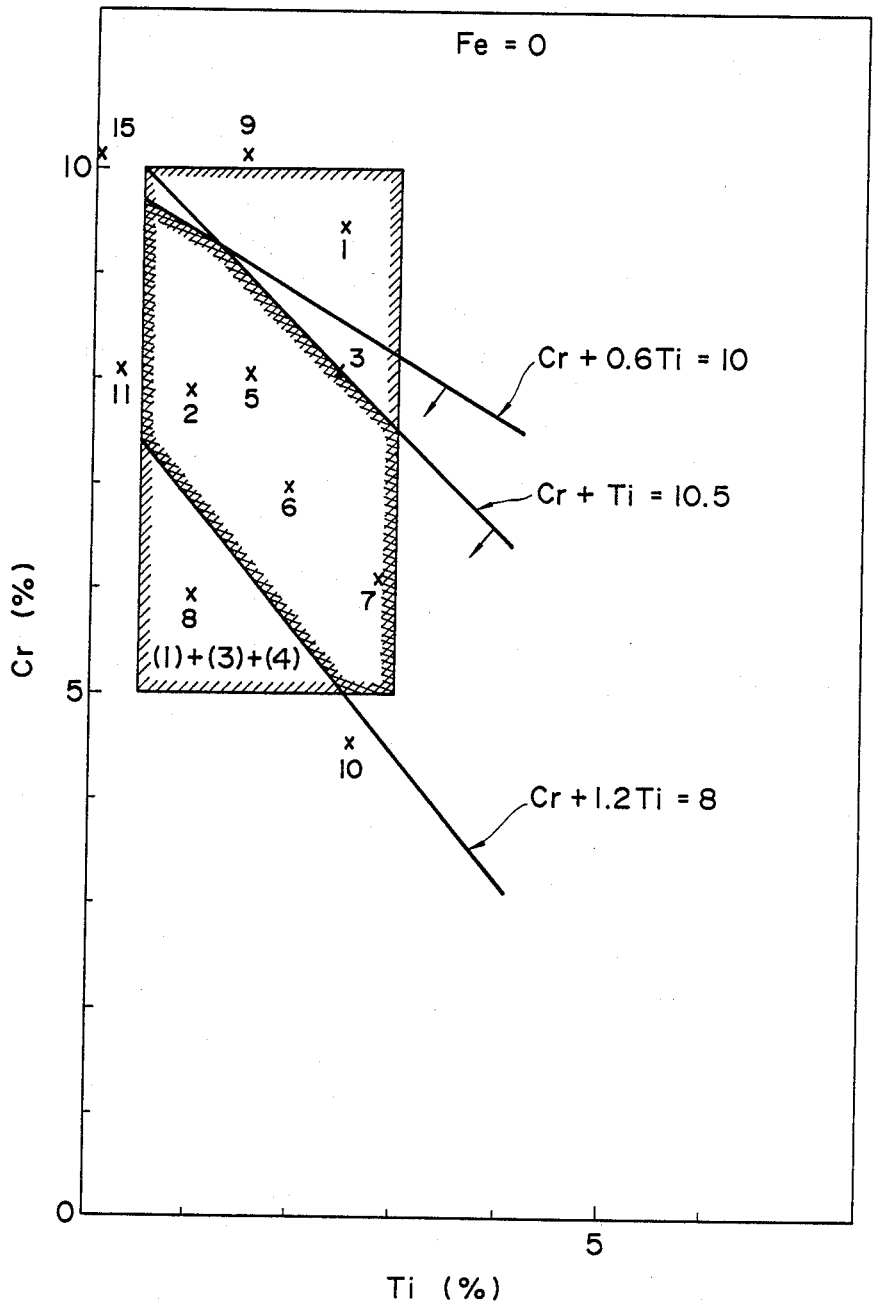
FIG. 3 is a graphical representation of the compositional range of the Al-Cr-Ti ternary alloy.

The effect of Cr has been already confirmed in prior art. With the Al-Cr-Ti ternary alloys of the invention, when the amount of Cr was less than 5% as in No. 10, satisfactory strength could not be obtained even in an increasing amount of Ti. Accordingly, the lower limit in amount of Cr was determined at 5%. When Cr was added in amounts over 10%, the elongation and reduction of area lowered as shown in No. 9 and the measurement of the 0.2% proof strength was difficult. FIG. 3 illustrates the composition range of Cr and Ti (including preferable ranges A) to C))

Figure 4:
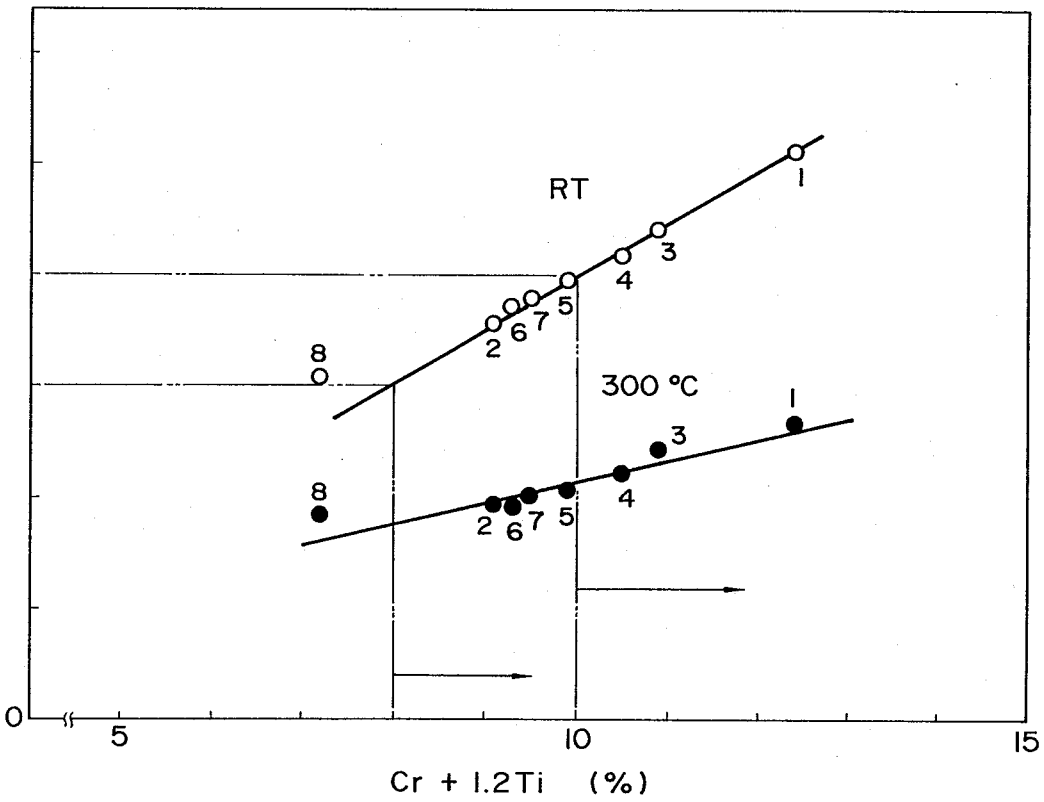
FIG. 4 is a graphical representation of room temperature strength and elevated temperature strength in relation to the variation in amount of (Cr+1.2Ti) in the ternary alloy.

As a result of the analysis of the data in Table 2, the room temperature strength and elevated temperature strength were found to linearly change in relation to the parameter of (Cr+1.2Ti) (see FIG. 4). In view of the fact that 5000 series alloys which are widely utilized as a structural material have a room temperature strength of about 30 kgf/mm², it will be seen that the value of (Cr+1.2Ti) is preferably not less than 8% as is seen from FIG. 4. On the other hand, the room temperature strength of the 2000 series alloys which are widely used as a known heat-resistant high strength material is approximately 40 kgf/mm². In view of the above, a more preferable value of (Cr+1.2Ti) is not less than 10% from FIG. 4. In Table 2, the alloys of the invention have elevated temperature strength at 300° C. higher by two times or more than the 2000 series alloys and are thus better.

Figure 5:
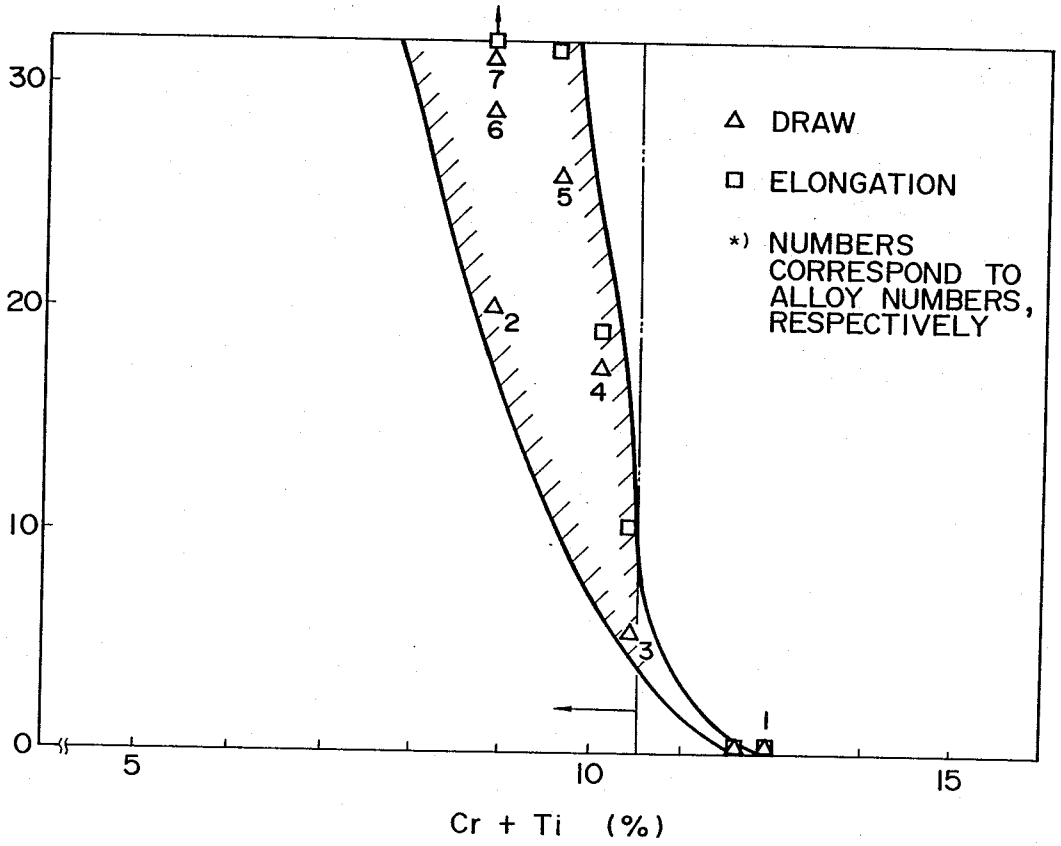
FIG. 5 is a graphical representation of elongation (8) and reduction of area (4) in relation to the variation in amount of Cr+Ti in the ternary alloy.

FIG. 5 plots the relation between elongation (δ) and reduction of area (ψ) in the room temperature tensile test and the amount of (Cr+Ti) in the respective alloys of Nos. 1 through 9. In a range where the amount of (Cr+Ti) exceeds 10.5%, the elongation and reduction of area, respectively, lower extremely. Accordingly, the value is preferably not larger than 10.5%.

Figure 6:
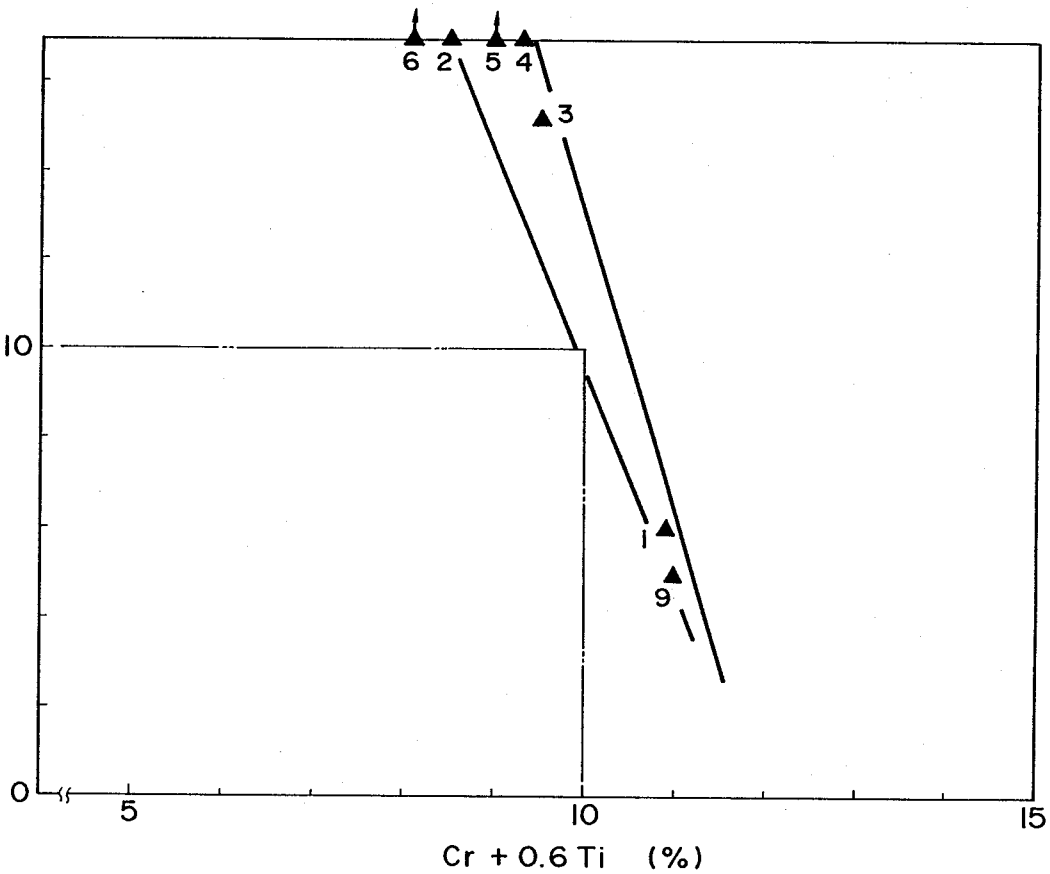
FIG. 6 is a graphical representation of toughness in relation to the variation in amount of (Cr+0.6Ti)

The analysis of the data of Nos. 1 to 9 reveals that the value of $\sigma_{NTS}/\sigma 0.2$ changes substantially linearly to the parameter of (Cr+0.6Ti). This is particularly shown in FIG. 6, from which it will be seen that in order that the value of $\sigma_{NTS}/\sigma 0.2$ is so determined to be 1 or over in which a lowering of the strength can rarely occur under a stress concentration as notched, the value of (Cr+0.6Ti) should preferably be not larger than 10%.

These relationships are summarized in Table 3 below.

TABLE 3

| | Requirement | Relationship |
|---|---|---|
| a | Possible to manufacture | Ti ≦ 3% |
| b | Normal temperature strength not less than 30 Kg/mm² | Cr ≧ 5% and Ti ≧ 0.5% and Cr + 1.2 Ti ≧ 8% |
| c | Better plastic workability | Cr + Ti ≦ 10.5% and Cr ≦ 10% |
| d | Better toughness (σ NTS/σ0.2 ≧ 1) | Cr + 0.6 Ti ≦ 10% |

EXAMPLE 2

As described before, when Fe is added to Al-Cr alloys, the heat resistance is improved remarkably. However, Fe has the effect of lowering toughness and care should be taken when the amount of Fe is determined. With the above in view, experiments were carried out using Al-Cr-Fe-Ti quanternary alloys.

Alloys of the composition indicated in Table 4 were atomized in the same manner as in Example 1, followed by making an alloy extrusion bar and subjecting the tensile tests in the same manner as in Example 1. The results are shown in Table 5.

TABLE 4

| | No. | Cr | Fe | Ti | Cr/Fe | Cr + 2.4 Fe + 1.2 Ti | Cr + Fe + Ti | Cr + 1.2 Fe + 0.6 Ti |
|---|---|---|---|---|---|---|---|---|
| Inventive | 18 | 8.97 | 4.14 | 0.93 | 2.1 | 20.0 | 14.0 | 14.5 |
| | 19 | 8.61 | 1.01 | 1.03 | 8.5 | 12.3 | 10.7 | 10.4 |
| | 20 | 8.02 | 0.60 | 0.99 | 13.3 | 10.6 | 9.6 | 9.3 |
| | 21 | 7.06 | 0.41 | 0.91 | 17.2 | 9.1 | 8.4 | 8.1 |
| | 22 | 7.09 | 1.45 | 1.06 | 4.8 | 11.8 | 9.6 | 9.5 |
| | 23 | 6.53 | 0.54 | 0.91 | 12 | 8.9 | 8.0 | 7.7 |
| | 24 | 6.10 | 3.07 | 1.06 | 1.9 | 14.7 | 10.2 | 10.4 |
| | 25 | 5.93 | 3.62 | 0.97 | 1.6 | 15.8 | 10.5 | 10.9 |
| | 26 | 5.40 | 1.09 | 1.00 | 4.9 | 9.2 | 7.5 | 7.3 |
| | 27 | 5.51 | 2.55 | 0.93 | 2.1 | 12.7 | 9.0 | 9.1 |
| | 28 | 9.11 | 4.11 | 2.01 | 2.2 | 21.4 | 15.2 | 15.2 |
| | 29 | 7.04 | 1.91 | 2.09 | 3.6 | 14.3 | 11.0 | 10.6 |
| | 30 | 7.53 | 0.47 | 2.06 | 16.0 | 11.1 | 10.1 | 9.3 |
| | 31 | 6.98 | 1.49 | 2.42 | 4.6 | 13.5 | 10.9 | 10.2 |
| | 32 | 6.58 | 0.55 | 2.05 | 11.9 | 10.4 | 9.2 | 8.5 |
| | 33 | 6.43 | 1.64 | 2.04 | 3.9 | 12.8 | 10.1 | 9.6 |
| | 34 | 5.97 | 1.87 | 1.91 | 3.1 | 12.8 | 9.8 | 9.4 |
| | 35 | 5.39 | 0.55 | 1.90 | 9.7 | 9.0 | 7.8 | 7.2 |
| | 36 | 6.57 | 2.62 | 0.42 | 2.5 | 13.4 | 9.6 | 10.0 |
| | 37 | 5.94 | 1.43 | 1.54 | 4.1 | 11.2 | 8.9 | 8.6 |
| | 38 | 7.88 | 1.01 | 1.51 | 7.8 | 12.1 | 10.4 | 10.0 |
| | 39 | 7.09 | 0.98 | 1.46 | 7.2 | 11.2 | 9.5 | 9.1 |
| | 40 | 5.41 | 1.92 | 2.50 | 2.8 | 13.0 | 9.8 | 9.2 |
| Alloy for Comparison | 41 | 9.43 | 5.40 | 1.92 | — | — | — | — |

TABLE 5

| | | Normal Temperature Tensile Strength | | | | | High Temperature Tensile Strength (300° C.) | | | |
|---|---|---|---|---|---|---|---|---|---|---|
| | No. | $\sigma$0.2 (kg/mm$^2$) | $\sigma$B (kg/mm$^2$) | $\delta$ (%) | $\psi$ (%) | $\sigma$ NTS/$\sigma$0.2 | $\sigma$0.2 (kg/mm$^2$) | $\sigma$B (kg/mm$^2$) | $\delta$ (%) | $\psi$ (%) |
| Inventive Alloys | 18 | — | 64.3 | <0.1 | 0.4 | — | — | 36.7 | 0.1 | 0.1 |
| | 19 | 40.0 | 49.3 | 2.1 | 5.8 | 0.89 | 20.9 | 25.8 | 1.6 | 4.3 |
| | 20 | 32.2 | 41.3 | 24.8 | 39.2 | 1.27 | 18.4 | 21.1 | 8.6 | 11.1 |
| | 21 | 26.5 | 36.2 | 31.3 | 52.8 | 1.59 | 14.5 | 19.5 | 8.7 | 21.2 |
| | 22 | 36.6 | 47.6 | 23.2 | 35.0 | 1.10 | 20.3 | 23.5 | 6.1 | 13.8 |
| | 23 | 25.1 | 34.2 | 33.3 | 44.2 | 1.92 | 14.1 | 18.3 | 10.0 | 24.8 |
| | 24 | 40.3 | 48.6 | 8.3 | 10.2 | 0.89 | 21.1 | 25.0 | 2.4 | 1.2 |
| | 25 | 43.4 | 51.8 | 4.3 | 8.2 | 0.68 | 21.8 | 26.3 | 3.5 | 3.8 |
| | 26 | 24.7 | 34.4 | 33.4 | 46.7 | 2.05 | 14.5 | 19.5 | 11.1 | 24.8 |
| | 27 | 40.3 | 50.0 | 29.7 | 40.0 | 1.41 | 21.8 | 26.5 | 8.8 | 21.2 |
| | 28 | — | 63.8 | <0.1 | 0.5 | — | — | 38.2 | 0.1 | 0.1 |
| | 29 | 47.3 | 57.2 | 4.5 | 4.8 | 1.00 | 25.6 | 30.0 | 2.2 | 4.6 |
| | 30 | 34.1 | 44.4 | 16.9 | 29.6 | 1.15 | 20.0 | 24.7 | 6.2 | 14.6 |
| | 31 | 44.5 | 55.0 | 1.4 | 2.3 | 0.93 | 23.6 | 28.5 | 3.6 | 4.2 |
| | 32 | 31.7 | 40.1 | 20.0 | 32.4 | 1.72 | 18.9 | 22.3 | 7.6 | 20.8 |
| | 33 | 41.6 | 52.1 | 19.9 | 34.7 | 1.04 | 22.1 | 28.0 | 8.3 | 12.4 |
| | 34 | 41.7 | 51.5 | 22.6 | 34.9 | 1.12 | 21.9 | 27.7 | 8.0 | 13.8 |
| | 35 | 24.1 | 33.3 | 32.0 | 49.2 | 2.19 | 15.0 | 19.1 | 10.1 | 27.3 |
| | 36 | 42.2 | 52.0 | 27.2 | 38.6 | 0.98 | 22.7 | 26.4 | 8.3 | 12.4 |
| | 37 | 34.6 | 43.5 | 24.4 | 36.8 | 1.7 | 19.1 | 23.1 | 9.1 | 13.6 |
| | 38 | 38.9 | 48.7 | 2.8 | 3.6 | 0.52 | 20.7 | 25.5 | 4.2 | 6.6 |
| | 39 | 34.3 | 44.1 | 23.8 | 30.5 | 1.47 | 19.4 | 23.5 | 6.4 | 12.1 |
| | 40 | 41.5 | 51.9 | 24.6 | 32.2 | 1.30 | 23.6 | 28.7 | 6.5 | 11.3 |
| Alloy for Comparison | 41 | — | — | — | — | — | — | — | — | — |

Figure 7:
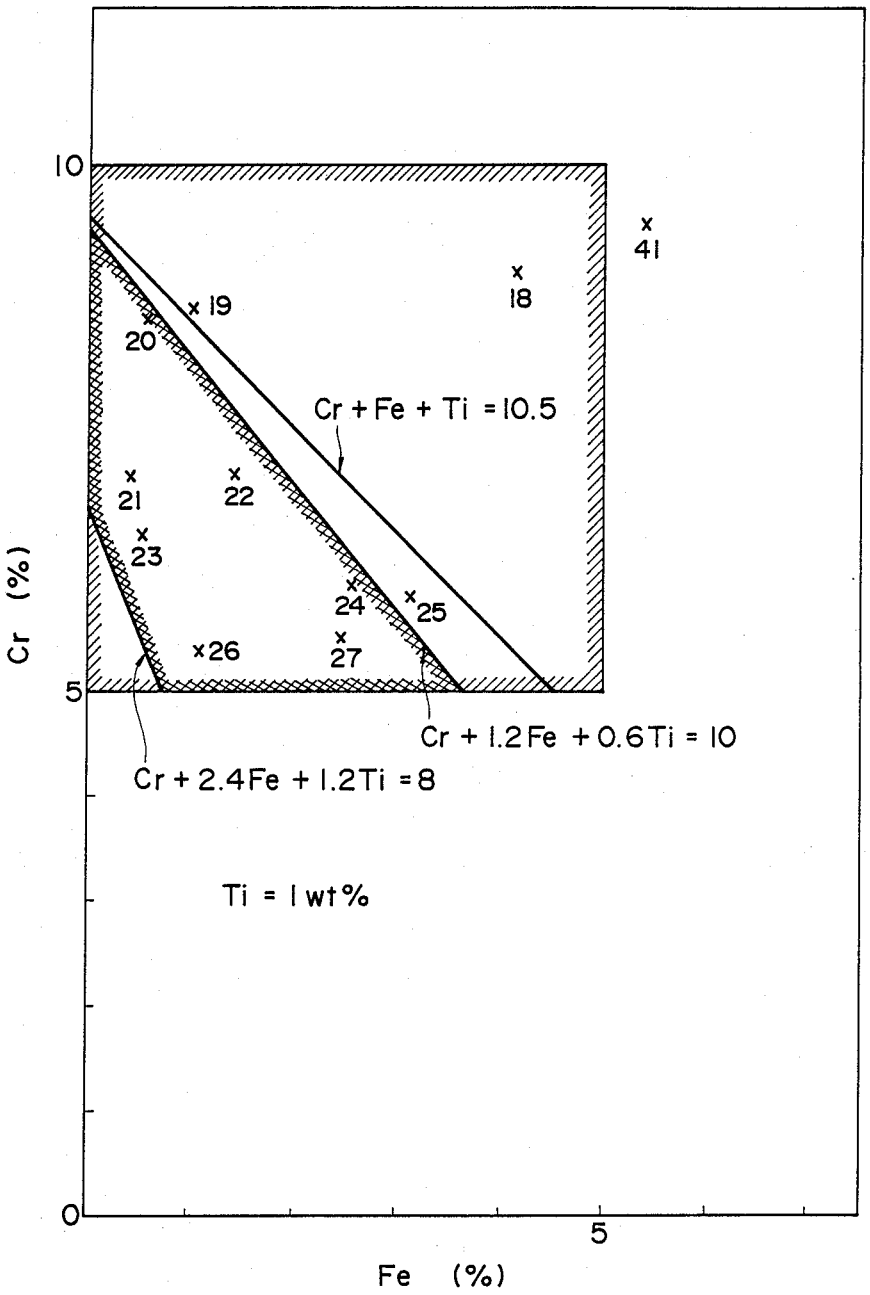
FIGS. 7 and 8 are, respectively, graphs showing a compositional range for 1% and 2% of Ti in an Al-Cr-Ti-Fe quaternary alloy.
Figure 8:
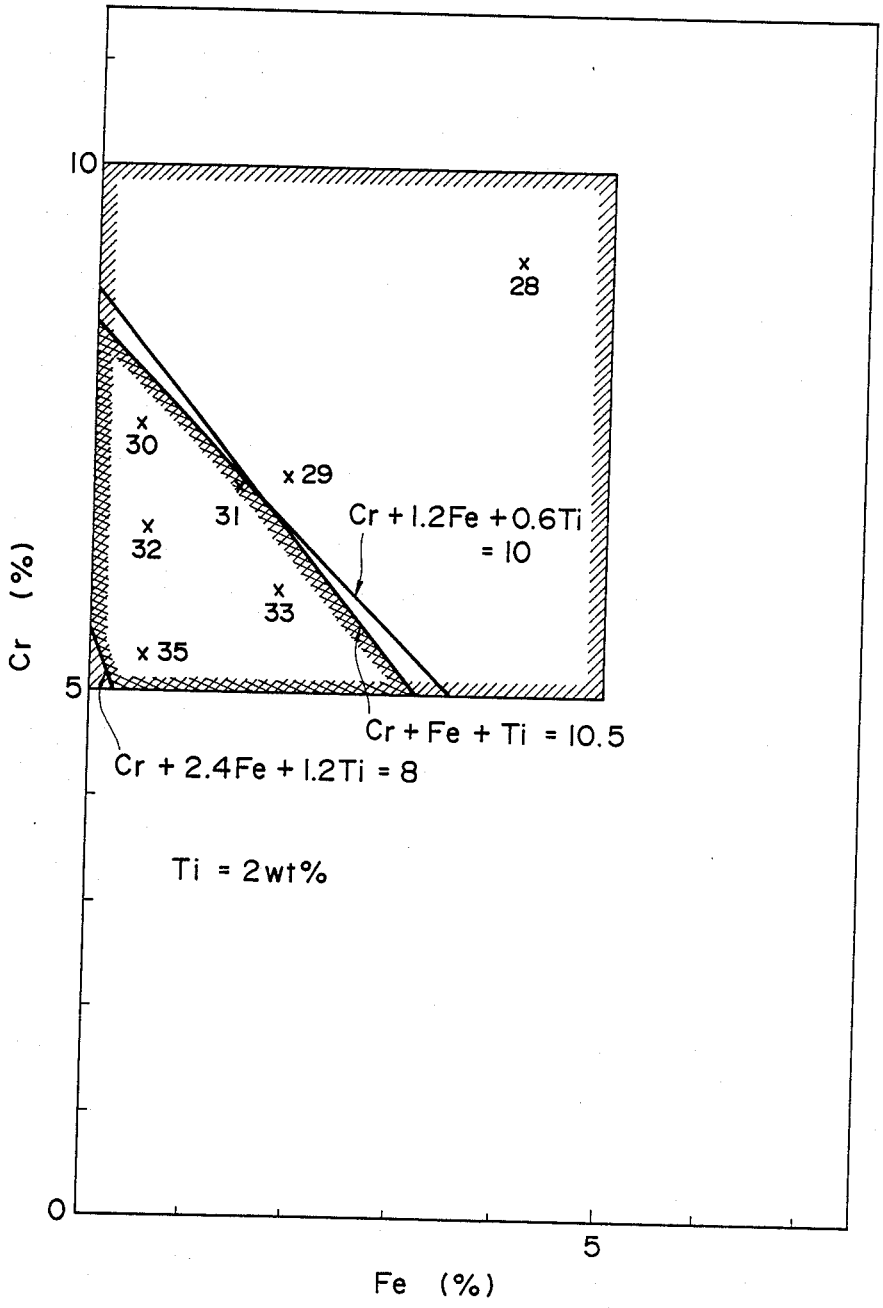

FIGS. 7 and 8, respectively, show preferable ranges (including the preferred ranges (A) through (C) discussed before) in composition when the amount of Ti is 1% or 2%. It will be noted that the numerical values in the figures correspond to the numbers of the alloys in this example.

Figure 9:
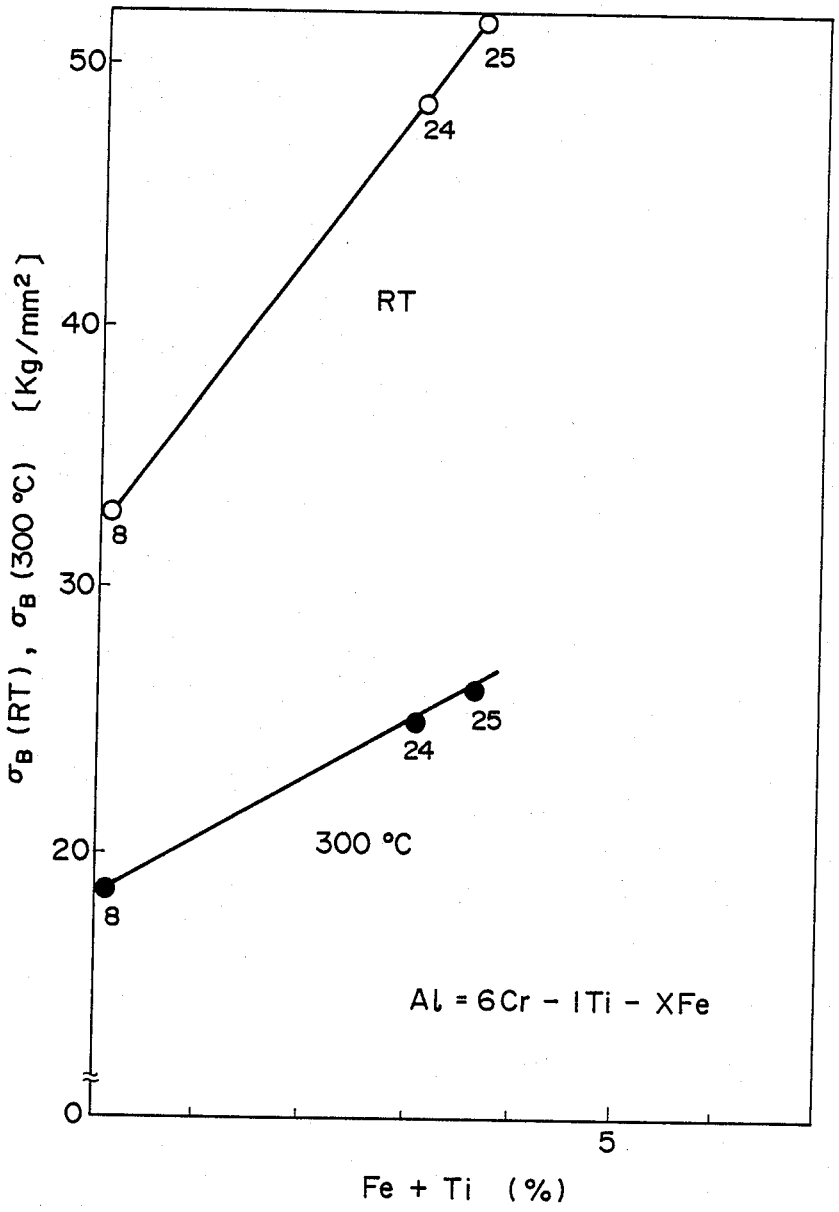
FIG. 9 is a graphical representation of room temperature strength and elevated temperature strength in relation to the variation in amount of Fe added to an Al-Cr-Ti ternary alloy.

When alloy No. 8 in Example 1 (Al-6%Cr-1%Ti) is compared with alloy Nos. 24 and 25, to which Fe is added, with respect to the room temperature strength and the elevated temperature strength, the results of FIG. 9 are obtained. From the FIG., it will be clear that Fe has an effect of improving the strengths and the heat resistance.

The alloy No. 41 indicated in Tables 4 and 5 is one in which the powder could be obtained but a test piece could not be obtained because of crackings during the extrusion operation. In view of this fact, the upper limit of Fe is 5%.

Figure 10:
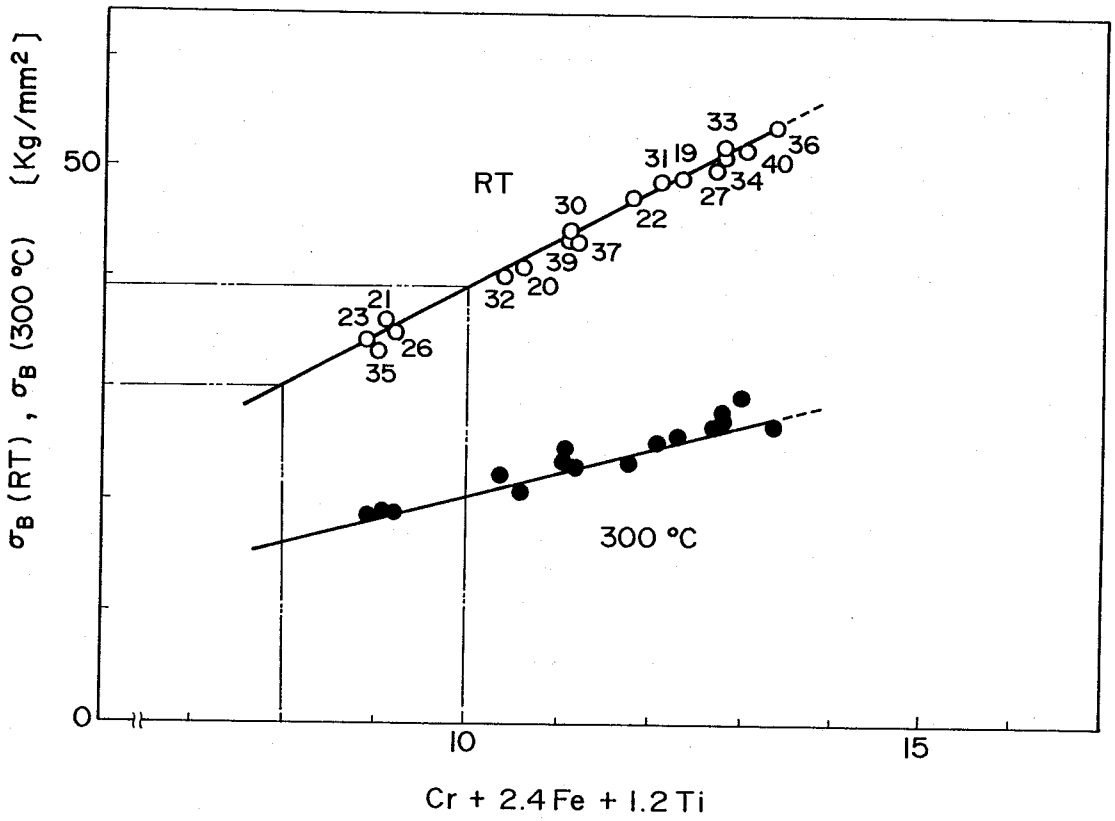
FIG. 10 is a graphical representation of room temperature strength and elevated temperature strength in relation to the variation in amount of (Cr+2.4Fe+1.2Ti) in the quaternary alloy.
Figure 11:
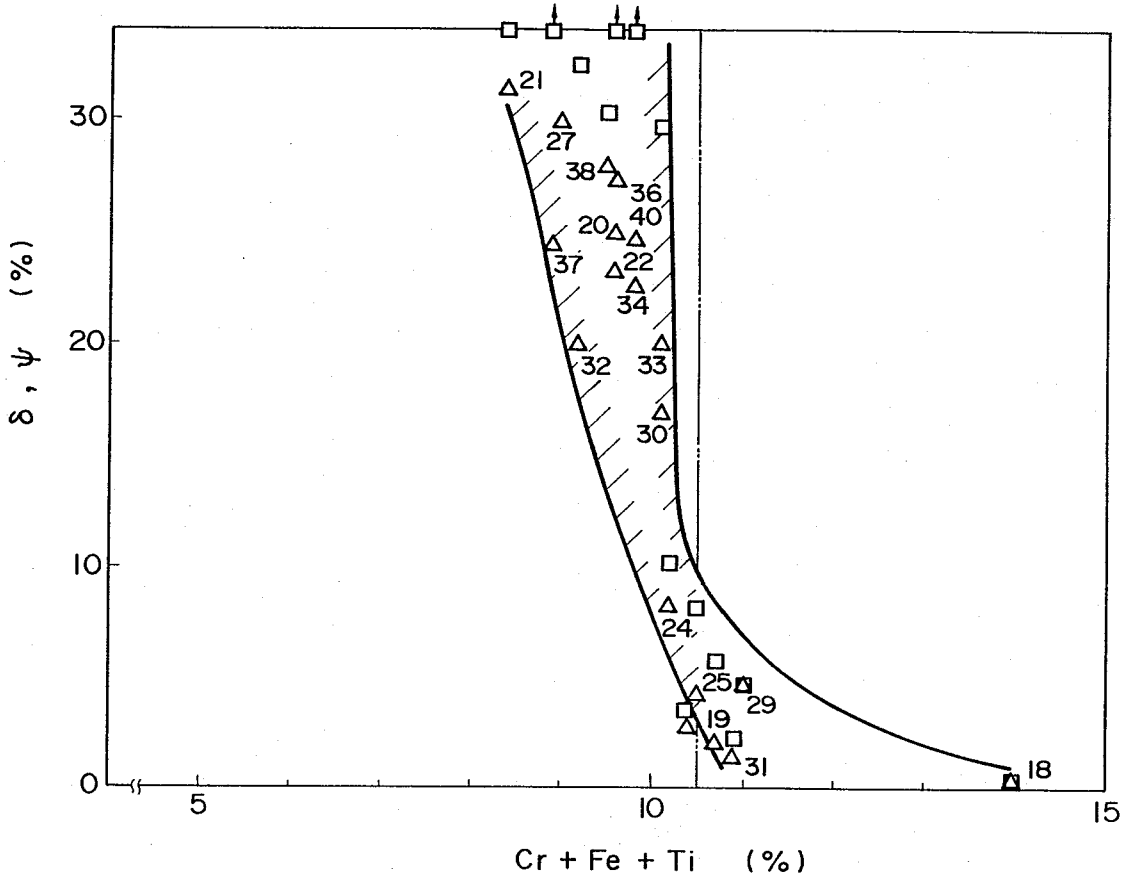
FIG. 11 is a graphical representation of elongation and reduction of area in relation to the variation in amount of (Cr+Fe+Ti) in the quanternary alloy.

The analysis of the data of Tables 4 and 5 reveal that the strengths at normal and high temperatures change substantially linearly in relation to the parameter of (Cr+2.4Fe+1.2Ti). This is particularly shown in FIG. 10. For the same reason as in Example 1, the value of (Cr+2.4Fe+1.2Ti) is preferably not less than 8%, more preferably not less than 10%. The elongation and draw are in close relation with the amounts of Cr, Fe and Ti. As is clearly seen from FIG. 11, when the total amount of (Cr+Fe+Ti) exceeds 10.5%, the elongation and reduction of area lower extremely.

Figure 12:
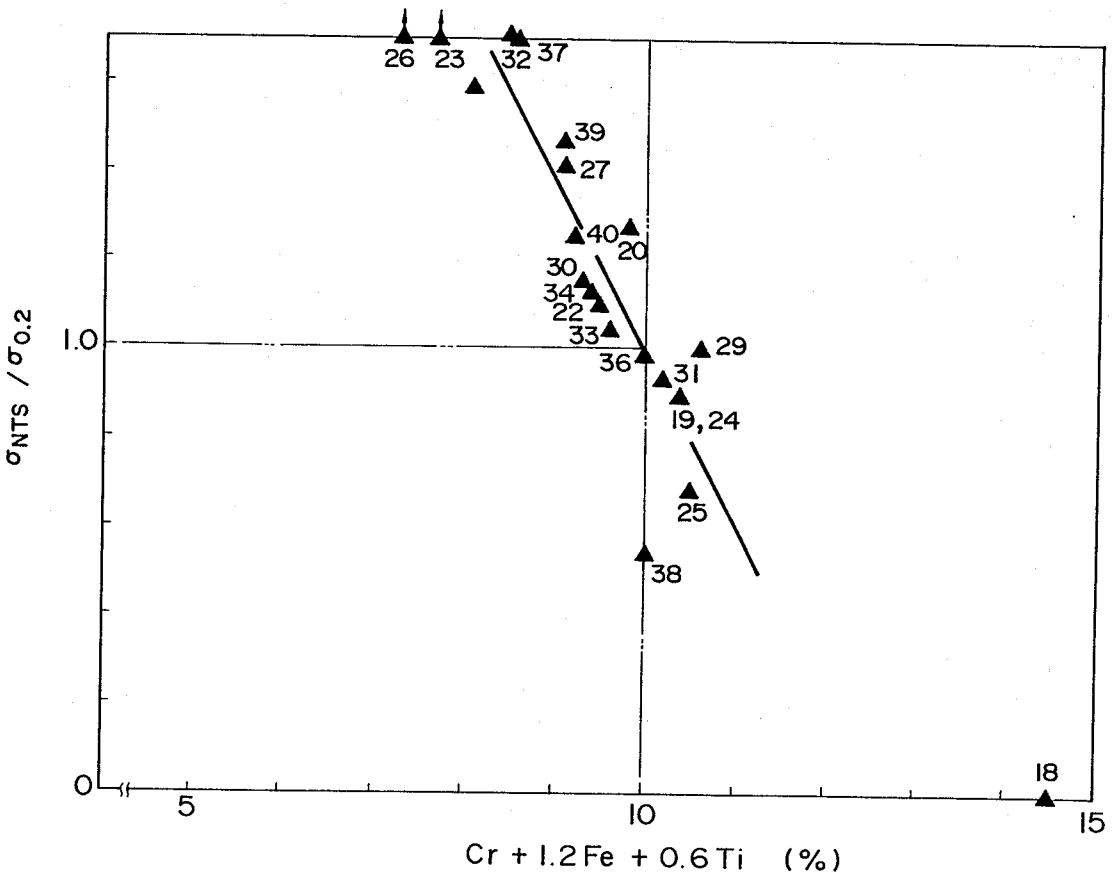
FIG. 12 is a graphical representation of toughness in relation to the variation in amount of (Cr+1.2Fe+0.6Ti) in the quaternary alloy.

The value of $\sigma_{NTS/\sigma}$0.2 has a substnatially linear relation with the parameter of (Cr+1.2Fe+0.6Ti) as shown in FIG. 12. In a range where the value exceeds 10%, it is almost impossible to find such a composition that the value of $\sigma_{NTS}/\sigma 0.2$ exceeds 1.

The results are summarized in Table 6 below.

TABLE 6

| | Requirement | Relationship |
|---|---|---|
| A | Possible to manufacture | Ti ≦ 3% and Fe ≦ 5% |
| B | Normal temperature strength not less than 30 Kgf/mm$^2$ | Cr ≧ 5% and Ti ≧ 0.5% and Cr + 2.4 Fe + 1.2 Ti ≧ 8% |
| C | Better workability | Cr + Fe + Ti ≦ 10.5% |
| D | Better toughness | Cr + 1.2 Fe + 0.6 Ti≦ 10% |

What is claimed is:

1. An Al-based alloy obtained by powder metallurgy and having a high heat resistance, good workability and good toughness, which consists essentially of from 5 to 10% by weight of Cr, from 0.5 to 3% by weight of Ti and the balance of Al and inevitable impurities, wherein the total amount of Cr+1.2 Ti is not less than 8% by weight of the alloy, the total amount of Cr+Ti is not larger than 10.5% by weight of the alloy, and the total amount of Cr+0.6 Ti is not larger than 10% by weight of the alloy.

2. An Al-based alloy obtained by powder metallurgy and having a high heat resistance, good workability and good toughness, which consists essentially of from 5 to 10% by weight of Cr, from 0.5 to 3% by weight of Ti, up to 5% by weight of Fe, and the balance Al and inevitable impurities, wherein the total amount of Cr+2.4 Fe+1.2 Ti is not less than 8% by weight of the alloy, the total amount of Cr+Fe+Ti is not larger than 10.5% by weight of the alloy, and the total amount of Cr+1.2 Fe+0.6 Ti is not larger than 10% by weight of the alloy.

3. An Al-based alloy according to claim 2, wherein the total amount of Cr+Fe+Ti is not less than 10% by weight of the alloy.

4. An Al-based alloy according to claim 2, wherein the total amount of Cr+Fe+Ti is not larger than 10% by weight of the alloy.

5. An Al-based alloy according to claim 1, wherein the total amount of Cr+Ti is not less than 10% by weight of the alloy.

6. An Al-based alloy according to claim 5, wherein the total amount of Cr+Ti is not larger than 10% by weight of the alloy.

* * * * *